US006462564B1

(12) United States Patent
Krausch et al.

(10) Patent No.: US 6,462,564 B1
(45) Date of Patent: Oct. 8, 2002

(54) METHOD FOR DETERMINING THE LOAD IN A TUMBLE DRYER

(75) Inventors: Uwe-Jens Krausch; Dietmar Pech; Ulrich Nehring, all of Berlin (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 0 days.

(21) Appl. No.: 09/138,352

(22) Filed: Aug. 21, 1998

(30) Foreign Application Priority Data

Aug. 21, 1997 (DE) ..... 197 36 419

(51) Int. Cl.[7] ..... G01R 27/08; F26B 11/02
(52) U.S. Cl. ..... 324/695; 34/595; D32/8
(58) Field of Search ..... 324/695, 693, 324/705, 665, 694; 34/562, 528, 596, 260, 261; D32/8

(56) References Cited

U.S. PATENT DOCUMENTS 4,422,247 A * 12/1983 Deschaaf ..... 34/562
5,450,015 A * 9/1995 Mastico et al. ..... 324/665
5,514,973 A * 5/1996 Byler, et al. ..... 324/695

FOREIGN PATENT DOCUMENTS

| | | |
|---|---|---|
| DE | 29 45 696 A1 | 5/1981 |
| DE | 44 03/625 A1 | 8/1995 |
| EP | 0 226 209 A2 | 6/1987 |

* cited by examiner

*Primary Examiner*—N. Le
*Assistant Examiner*—J. Kerveros
(74) *Attorney, Agent, or Firm*—Laurence A. Greenberg; Werner H. Stemer; Gregory L. Mayback

(57) ABSTRACT

A method for determining a load in a tumble dryer. Initially, laundry is moved in a laundry drum and the electrical conductivity of the laundry is determined by electrodes residing in the laundry drum. The method is distinguished by the fact that a range of fluctuation of the electrical conductivity is determined and serves as a measure of the load. As a result, the determination of the load can be carried out without an additional outlay for components and circuitry in the case in which a conductivity measurement is already implemented in the tumble dryer. The method is particularly suitable to be carried out by a microcontroller.

8 Claims, 1 Drawing Sheet

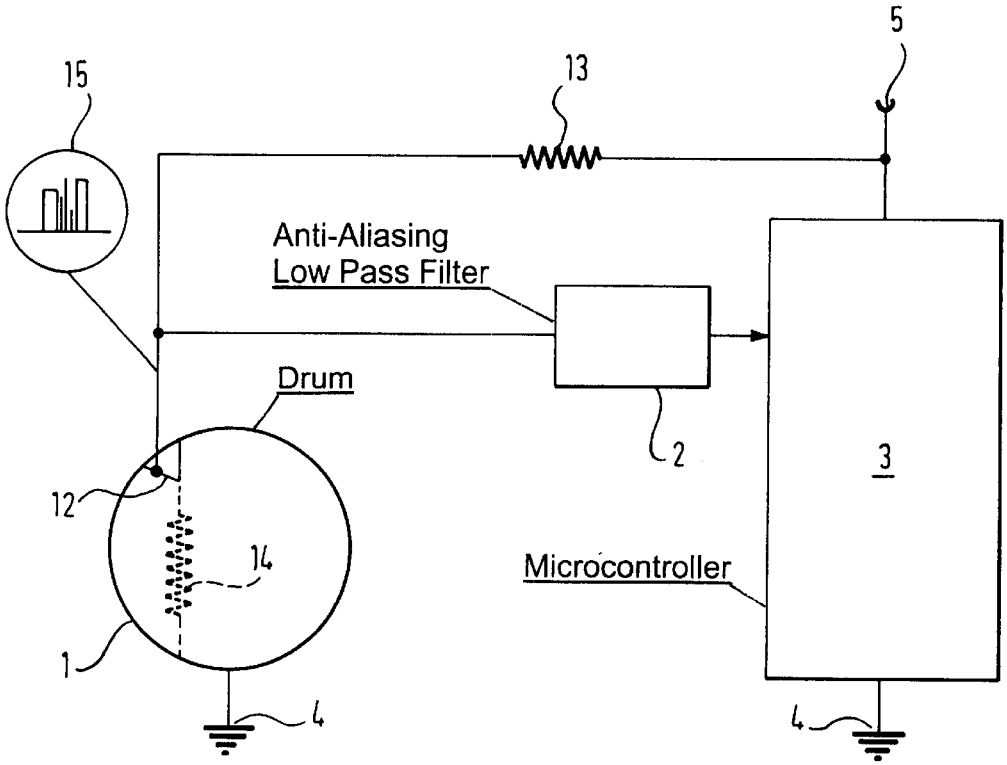
5
15
13
Anti-Aliasing
Low Pass Filter
Drum
2
3
12
14
Microcontroller
1
4
4

METHOD FOR DETERMINING THE LOAD IN A TUMBLE DRYER

BACKGROUND OF THE INVENTION

1. Field of the Invention

The present invention relates to a method for determining the load in a tumble dryer. The tumble dryer is provided with electrodes for determining the electrical conductivity of laundry in the tumble dryer.

During the drying operation, in addition to the moisture and the type of laundry, which is usually dried in a drum, among other factors, the load in the tumble dryer also plays a major part in the drying process. It is therefore advantageous for various reasons to determine the load in the tumble dryer, for example in order to predict the remaining time accurately, in order to control the drying process in an optimum fashion or in order to output a heating capacity that is matched to the heating requirement.

The prior art discloses methods of determining the load in tumble dryers which are based on the evaluation of temperature measurements or temperature gradient measurements, on the current demand of the motor to move the laundry drum or on a measurement of the electrical capacitance of the drum.

Furthermore, a method for determining the load in tumble dryers in which the electrical conductivity of the laundry is used is disclosed in Published, Non-Prosecuted, German Patent Application DE 29 45 696 A1. According to that document, the drum has fitted in it two electrodes, which touch the laundry from time to time as the drum rotates and by which the electrical conductivity of the laundry is determined. The conductivity signal, which varies with the movement of the laundry in the drum and exhibits pulses, is connected to a threshold-value circuit. The conductivity signal indicates that there is a piece of laundry resting on the electrodes, even in the dry state, by outputting a hit signal of a constant level which is subsequently integrated. The more frequently and the longer a piece of laundry is resting on the electrodes, the more frequent and longer are the hit signals and the higher is the value of the integral of these hit signals. The integral of the hit signals therefore constitutes a measure of the load in the tumble dryer, which can be used to control the drying process.

The above-described method for determining the load in tumble dryers has disadvantages. The formation of the threshold value, with subsequent integration of the hit signals, requires a high outlay of components and circuitry, which is uneconomic and increases the risk of failure. Furthermore, the method functions only if the conductivity falls to a very low value which lies still further below that which corresponds to the conductivity of dry laundry, so that even slight disturbances in the conductivity measurement leads to an erroneous determination of the load. Since the determined conductivity must assume very low values, at least from time to time, in order for the method to function, in the case of a high load, in which a piece of laundry is always resting on the electrodes, a precise determination of the load is no longer possible.

SUMMARY OF THE INVENTION

It is accordingly an object of the invention to provide a method for determining a load in a tumble dryer which overcomes the above-mentioned disadvantages of the prior art methods of this general type, which exhibits a high insensitivity to interference, even in the case of a high load, resulting in a reliable determination of the load and with a low outlay for components and circuitry.

With the foregoing and other objects in view there is provided, in accordance with the invention, a load determining method for a tumble dryer, which includes: moving laundry in a laundry drum having electrodes; measuring electrical conductivity of the laundry as a result of contact occurring at least from time to time between the laundry and the electrodes of the laundry drum; and determining a range of fluctuation of the measured electrical conductivity, the range of fluctuation serving measure of a load.

According to the invention, the range of fluctuation of the electrical conductivity is determined and used as a measure of the load. In the case of a low load in the tumble dryer, the probability that no piece of laundry is resting on the electrode is high, with the result that a large range of fluctuation of the conductivity is established. The greater the load becomes, the lower the probability that there is no piece of laundry resting on the electrode, and the range of fluctuation of the conductivity is low.

This method enables the determination of the load with a low outlay, or even without additional outlay, in components and circuitry, since it is based on a conductivity measurement which is implemented in any case in most tumble dryers in order to determine the moisture of the laundry. Furthermore, the method permits a precise determination of the load, even in the case of a relatively high load, since each change in the determined conductivity is registered, without the conductivity having to fall below a specific threshold. This also results in a higher insensitivity with respect to interference.

Advantageously, the range of fluctuation is determined as the difference between the maximum and minimum values of the conductivity within a specific time interval. By restricting the determination of the range of fluctuation to a time interval, it is possible to influence the frequency of the ascertained values of the range of fluctuation by varying the time interval, and to reduce the influence of short-term interference by increasing the duration of the time interval.

Furthermore, the conductivity is advantageously measured at periodic intervals and the range of fluctuation of the individual conductivity measurements is determined. By obtaining discrete conductivity values, it is possible for the determination and evaluation of the range of fluctuation to be carried out without problems, using digital components. Furthermore, by selecting the measuring period, the frequency of the ascertained conductivity values, and therefore the outlay in computing needed for the evaluation, may be determined freely depending on the requirements and options.

Advantageously, the maximum and minimum values of the measured conductivities are averaged and the range of fluctuation of the averages in each case is determined. By averaging, the influence of short-term interference is reduced, and the measurement certainty of the determination of the load is increased. In addition, it is also possible to suppress values that appear to be implausible, such as outliers, and not to take them into account during the averaging process.

It is also advantageous to determine the range of fluctuation several times, to average the ranges of fluctuation obtained and to use the average range of fluctuation as a measure of the load. By this method, the influence of short-term interferences can be reduced, and the measurement certainty can be increased. In addition, it is also possible here to detect values that appear to be implausible, such as outliers, and not to take them into account during the averaging process.

Furthermore, it is advantageous to carry out the determination of the range of fluctuation of the conductivity essentially from the start of the drying process and preferably only over a relatively short period of time, since at this point in time pieces of laundry which dry at different speeds still have an approximately equal moisture, and thus conductivity differences on account of different degrees of moisture do not have a disruptive influence on the determination of the load.

It is particularly advantageous to make use of a microcontroller with an associated analog/digital convertor in order to determine the range of fluctuation of the conductivity. This is particularly advantageous when a microcontroller with associated analog/digital convertor is used in any case to control the tumble dryer, since in such a case no additional outlay of components and circuitry is required at all. Irrespective of this, it is possible in any case to achieve a very high accuracy in determining the load, and this with a relatively low outlay on components and circuitry.

Other features which are considered as characteristic for the invention are set forth in the appended claims.

Although the invention is illustrated and described herein as embodied in a method for determining the load in a tumble dryer, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

The FIGURE of the drawing is a block circuit diagram of a structure for carrying out one embodiment of the method according to the invention.

DESCRIPTION OF THE PREFERRED EMBODIMENTS

Referring now to the single FIGURE of the drawing in detail, there is shown a drum 1 having a first electrode 12, the drum 1 itself serving as a second electrode. In order to obtain the conductivity of laundry in the drum 1, the drum 1 is connected to a ground 4 of a tumble dryer, and the first electrode 12 is connected via a bias resistor 13 to a constant voltage 5. The laundry in the drum 1 has a laundry resistance 14, which on one side is connected via the drum 1 to the ground 4 of the tumble dryer and on the other side is connected via the first electrode 12 to the bias resistor 13, and therefore forms a voltage divider with the latter. At the junction between the laundry resistance 14 and the bias resistor 13, a measured signal 15 is obtained which serves as a measure of the conductivity of the laundry. The measured conductivity signal 15 is connected to an input of an anti-aliasing low-pass filter 2, whose output is connected to an analog input of a microcontroller 3.

The load in the tumble dryer is determined during movement of the laundry in the drum 1 as a result of its rotation. During the rotation, the laundry touches the first electrode 12, at least from time to time, which results in the measured conductivity signal 15 that varies with time. Each time a piece of laundry touches the first electrode 12, or each time the laundry resistance 14 measured between the first electrode 12 and the drum 1 changes, the measured conductivity signal 15 will exhibit a jump or a pulse. In those cases in which no piece of laundry touches the first electrode 12, or a piece of laundry touches the first electrode 12 only very little, and therefore a low conductivity is determined, the measured conductivity signal 15 exhibits a minimum value. Given a very good electrical connection between the first electrode 12 and the laundry, on the other hand, the measured conductivity signal 15 will exhibit a maximum value. The measured conductivity signal 15 is measured by the microcontroller 3 with the anti-aliasing filter 2 being interposed in order to prevent erroneous measurements. The microcontroller 3 measures the conductivity at periodic intervals and determines the range of fluctuation by forming the difference between a maximum and a minimum value of the conductivity within a specific time interval.

By taking into account the fact that a relatively high range of fluctuation is established in the case of a low load, the microcontroller 3 is able to determine the load in the tumble dryer from the range of fluctuation of the electrical conductivity.

Thus, the novel solution provides a method for determining the load in the tumble dryer with which a precise determination of the load is possible, even with a high load, and high insensitivity with respect to interference can be achieved while avoiding a high outlay in components and circuitry. The method may be used particularly advantageously in tumble dryers in which the microcontroller 3 is used in any case, and a measurement of the conductivity of the laundry is carried out.

We claim:

1. A load determining method for a tumble dryer, which comprises:

moving laundry in a laundry drum of a tumble dryer, the laundry drum having electrodes;

measuring electrical conductivity of the laundry as a result of contact occurring at least from time to time of the laundry with the electrodes of the laundry drum; and determining a range of fluctuation of the measured electrical conductivity, the range of fluctuation serving as a measure of a load.

2. The method according to claim 1, which comprises determining the range of fluctuation as a difference between a maximum value and a minimum value of the measured electrical conductivity within a specific time interval.

3. The method according to claim 1, which comprises measuring the electrical conductivity at periodic intervals resulting in a plurality of individually measured electrical conductivities and determining the range of fluctuation of each of the individually measured electrical conductivities.

4. The method according to claim 3, which comprises deriving an averaged maximum value and an averaged minimum value from maximum values and minimum values of the individually measured electrical conductivities and determining a range of fluctuation from the averaged maximum value and the averaged minimum value.

5. The method according to claim 1, which comprises:

taking a plurality of electrical conductivity measurements;

determining the range of fluctuation for each of the plurality of electrical conductivity measurements resulting in a plurality of ranges of fluctuation; and averaging the ranges of fluctuation resulting in an averaged range of fluctuation, the averaged range of fluctuation serving as the measure of the load.

6. The method according to claim 1, which comprises carrying out the measuring and the determining steps essentially from a start of a drying process.

7. The method according to claim 6, which comprises carrying out the measuring and the determining steps over a relatively short period of time.

8. The method according to claim 1, which comprises using a microcontroller with an associated analog/digital converter for determining the range of fluctuation of the electrical conductivity.

* * * * *